US006260380B1

(12) United States Patent
Arman et al.

(10) Patent No.: US 6,260,380 B1
(45) **Date of Patent: *Jul. 17, 2001**

(54) CRYOGENIC AIR SEPARATION PROCESS FOR PRODUCING LIQUID OXYGEN

(75) Inventors: Bayram Arman; Dante Patrick Bonaquist, both of Grand Island; Joseph Alfred Weber, Cheektowaga; Mark Edward Vincett, Lancaster, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/533,251

(22) Filed: Mar. 23, 2000

(51) Int. Cl.[7] ..... F25J 3/00
(52) U.S. Cl. ..... 62/646; 62/912
(58) Field of Search ..... 62/623, 646, 641, 62/912

(56) References Cited

U.S. PATENT DOCUMENTS

| | | | | |
|---|---|---|---|---|
| 3,564,571 | * | 2/1971 | Yearout | 62/912 |
| 3,733,845 | | 5/1973 | Lieberman | 62/335 |
| 3,747,359 | * | 7/1973 | Streich | 62/623 |
| 4,192,662 | * | 3/1980 | Ogata et al. | 62/912 |
| 4,375,367 | | 3/1983 | Prentice | 62/13 |
| 5,123,946 | | 6/1992 | Ha | 62/11 |
| 5,157,925 | | 10/1992 | Denton et al. | 62/11 |
| 5,287,704 | | 2/1994 | Rathbone | 62/25 |
| 5,402,647 | | 4/1995 | Bonaquist et al. | 62/24 |
| 5,441,658 | | 8/1995 | Boyarsky et al. | 252/67 |
| 5,511,381 | | 4/1996 | Higginbotham | 62/646 |
| 5,579,654 | | 12/1996 | Longsworth et al. | 62/511 |
| 5,622,644 | | 4/1997 | Stevenson et al. | 252/67 |
| 5,650,089 | | 7/1997 | Gage et al. | 252/67 |
| 5,701,761 | * | 12/1997 | Prevost et al. | 62/613 |
| 5,729,993 | | 3/1998 | Boiarski et al. | 62/175 |
| 6,053,008 | * | 4/2000 | Arman et al. | 62/646 |

* cited by examiner

*Primary Examiner*—William Doerrler
(74) *Attorney, Agent, or Firm*—Stanley Ktorides

(57) ABSTRACT

A cryogenic air separation process for producing liquid oxygen and other liquid products wherein refrigeration generation for the process is decoupled from the flow of process streams and is produced at least in part by at least on multicomponent refrigerant fluid refrigeration circuit.

10 Claims, 2 Drawing Sheets

CRYOGENIC AIR SEPARATION PROCESS FOR PRODUCING LIQUID OXYGEN

TECHNICAL FIELD

This invention relates generally to the separation of feed air by cryogenic rectification and, more particularly, to the production of liquid oxygen and other liquid products.

BACKGROUND ART

The production of liquids, such as liquid oxygen, by the cryogenic rectification of feed air requires the provision of a significant amount of refrigeration to drive the separation because a significant amount of refrigeration is removed from the columns with the product liquid. Generally such refrigeration is provided by the turboexpansion of a process stream, such as a portion of the feed air. While this conventional practice is effective, it is limiting because an increase in the amount of refrigeration inherently affects the operation of the overall process. It is therefor desirable to have a cryogenic air separation process which can produce significant amounts of liquid product wherein the provision of the requisite refrigeration is independent of the flow of process streams for the system.

One method for providing refrigeration for a cryogenic air separation system which is independent of the flow of internal system process streams is to provide the requisite refrigeration in the form of exogenous cryogenic liquid brought into the system. Unfortunately such a procedure is very costly.

Accordingly it is an object of this invention to provide an improved cryogenic air separation process which can produce significant amounts of liquid product wherein the provision of the requisite refrigeration for the separation is independent of the flow of process streams.

It is another object of this invention to provide a cryogenic air separation process which can produce significant amounts of liquid product wherein the provision of the requisite refrigeration for the separation is independently and efficiently provided to the system.

SUMMARY OF THE INVENTION

The above and other objects which will become apparent to those skilled in the art upon a reading of this disclosure are attained by the present invention which is:

A process for the production of liquid oxygen by the cryogenic rectification of feed air comprising:

(A) compressing a multicomponent refrigerant fluid, cooling the compressed multicomponent refrigerant fluid, expanding the cooled, compressed multicomponent refrigerant fluid, and warming the expanded multicomponent refrigerant fluid by indirect heat exchange with said cooling compressed multicomponent refrigerant fluid and also with feed air to produce cooled feed air;

(B) passing the cooled feed air into a higher pressure cryogenic rectification column and separating the feed air by cryogenic rectification within the higher pressure cryogenic rectification column into nitrogen-enriched fluid and oxygen-enriched fluid;

(C) passing nitrogen-enriched fluid and oxygen-enriched fluid into a lower pressure cryogenic rectification column, and separating the fluids passed into the lower pressure column by cryogenic rectification to produce nitrogen-rich fluid and oxygen-rich fluid; and (D) withdrawing oxygen-rich fluid from the lower portion of the lower pressure column as liquid and recovering the withdrawn oxygen-rich fluid as product liquid oxygen.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component (s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluid streams into heat exchange relation without any physical contact or intermixing of the fluids with each other.

As used herein the term "expansion" means to effect a reduction in pressure.

As used herein the term "liquid nitrogen" means a liquid having a nitrogen concentration of at least 95 mole percent.

As used herein the term "liquid oxygen" means a liquid having an oxygen concentration of at least 85 mole percent.

As used herein the term "liquid argon" means a liquid having an argon concentration of at least 90 mole percent.

As used herein the term "low boiling component" means a component having an atmospheric boiling point less than 140 K.

As used herein the term "medium boiling component" means a component having an atmospheric boiling point within the range of from 140 K to 220 K.

As used herein the term "high boiling component" means a component having an atmospheric boiling point greater than 220 K.

As used herein the term "feed air" means a mixture comprising primarily oxygen, nitrogen and argon, such as ambient air.

As used herein the terms "upper portion" and "lower portion" mean those sections of a column respectively above and below the mid point of the column.

As used herein the term "variable load refrigerant" means a multicomponent fluid, i.e. a mixture of two or more components, in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the multicomponent refrigerant fluid is at least 10° K, preferably at least 20° K and most preferably at least 50° K.

As used herein the term "fluorocarbon" means one of the following: tetrafluoromethane ($CF_4$), perfluoroethane ($C_2F_6$), perfluoropropane ($C_3F_8$), perfluorobutane ($C_4F_{10}$), perfluoropentane ($C_5F_{12}$), perfluoroethene ($C_2F_4$), perfluoropropene ($C_3F_6$), perfluorobutene ($C_4F_8$), perfluoropentene ($C_5F_{10}$), perfluorohexane ($C_6F_{14}$), hexafluorocyclopropane (cyclo-$C_3F_6$) and octafluorocyclobutane (cyclo-$C_4F_8$).

As used herein the term "hydrofluorocarbon" means one of the following: fluoroform ($CHF_3$), pentafluoroethane ($C_2HF_5$), tetrafluoroethane ($C_2H_2F_4$), heptafluoropropane ($C_3HF_7$), hexafluoropropane ($C_3H_2F_6$), pentafluoropropane ($C_3H_3F_5$), tetrafluoropropane ($C_3H_4F_4$), nonafluorobutane ($C_4HF_9$), octafluorobutane ($C_4H_2F_8$), undecafluoropentane ($C_5HF_{11}$), methyl fluoride ($CH_3F$), difluoromethane ($CH_2F_2$), ethyl fluoride ($C_2H_5F$), difluoroethane ($C_2H_4F_2$), trifluoroethane ($C_2H_3F_3$), difluoroethene ($C_2H_2F_2$), trifluoroethene ($C_2HF_3$), fluoroethene ($C_2H_3F$), pentafluoropropene ($C_3HF_5$), tetrafluoropropene ($C_3H_2F_4$), trifluoropropene ($C_3H_3F_3$), difluoropropene ($C_3H_4F_2$), heptafluorobutene ($C_4HF_7$), hexafluorobutene ($C_4H_2F_6$), hexafluorobutane ($C_4H_4F_6$), decafluoropentane ($C_5H_2F_{10}$), undecafluoropentane ($C_5HF_{11}$) and nonafluoropentene ($C_5HF_9$).

As used herein the term "fluoroether" means one of the following: trifluoromethyoxy-perfluoromethane ($CF_3$—O—$CF_3$), difluoromethoxy-perfluoromethane ($CHF_2$—O—$CF_3$), fluoromethoxy-perfluoromethane ($CH_2F$—O—$CF_3$), difluoromethoxy-difluoromethane ($CHF_2$—O—$CHF_2$), difluoromethoxy-perfluoroethane ($CHF_2$—O—$C_2F_5$), difluoromethoxy-1,2,2,2-tetrafluoroethane ($CHF_2$—O—$C_2HF_4$), difluoromethoxy-1,1,2,2-tetrafluoroethane ($CHF_2$—O—$C_2HF_4$), perfluoroethoxy-fluoromethane ($C_2F_5$—O—$CH_2F$), perfluoromethoxy-1,1,2-trifluoroethane ($CF_3$—O—$C_2H_2F_3$), perfluoromethoxy-1,2,2-trifluoroethane ($CF_3O$—$C_2H_2F_3$), cyclo-1,1,2,2-tetrafluoropropylether (cyclo-$C_3H_2F_4$—O—), cyclo-1,1,3,3-tetrafluoropropylether (cyclo-$C_3H_2F_4$—O—), perfluoromethoxy-1,1,2,2-tetrafluoroethane ($CF_3$—O—$C_2HF_4$), cyclo-1,1,2,3,3-pentafluoropropylether (cyclo-$C_3H_5$—O—), perfluoromethoxy-perfluoroacetone ($CF_3$—O—$CF_2$—O—$CF_3$), perfluoromethoxy-perfluoroethane ($CF_3$—O—$C_2F_5$), perfluoromethoxy-1,2,2,2-tetrafluoroethane ($CF_3$—O—$C_2HF_4$), perfluoromethoxy-2,2,2-trifluoroethane ($CF_3$—O—$C_2H_2F_3$), perfluoropropoxy-methane ($C_3F_7$—O—$CH_3$), perfluoroethoxy-methane ($C_2F_5$—O—$CH_3$), perfluorobutoxy-methane ($C_4F_9$—O—$CH_3$), cyclo-perfluoromethoxy-perfluoroacetone (cyclo-$CF_2$—O—$CF_2$—O—$CF_2$—) and cyclo-perfluoropropylether (cyclo-$C_3F_6$—O).

As used herein the term "atmospheric gas" means one of the following: nitrogen ($N_2$), argon (Ar), krypton (Kr), xenon (Xe), neon (Ne), carbon dioxide ($CO_2$), oxygen ($O_2$) and helium (He).

As used herein the term "non-toxic" means not posing an acute or chronic hazard when handled in accordance with acceptable exposure limits.

As used herein the term "non-flammable" means either having no flash point or a very high flash point of at least 600° K.

As used herein the term "low-ozone-depleting" means having an ozone depleting potential less than 0.15 as defined by the Montreal Protocol convention wherein dichlorofluoromethane ($CCl_2F_2$) has an ozone depleting potential of 1.0.

As used herein the term "non-ozone-depleting" means having no component which contains a chlorine, bromine or iodine atom.

As used herein the term "normal boiling point" means the boiling temperature at 1 standard atmosphere pressure, i.e. 14.696 pounds per square inch absolute.

DETAILED DESCRIPTION

In general, the invention comprises the decoupling of the refrigeration generation for a cryogenic air separation process which produces liquid product from the flow of process streams for the process. This enables one to change the amount of refrigeration put into the process without requiring a change in flow of process streams. The invention enables the production of large amounts of liquid product without burdening the system with excessive turboexpansion of process streams to generate the refrigeration necessary to produce such liquid product by providing the capability to provide variable refrigeration supply as a function of temperature level thus enabling improved cooling curve matching. If desired, a portion of the requisite refrigeration for the plant may be provided by other means such as turboexpansion of a process stream.

Figure 1:
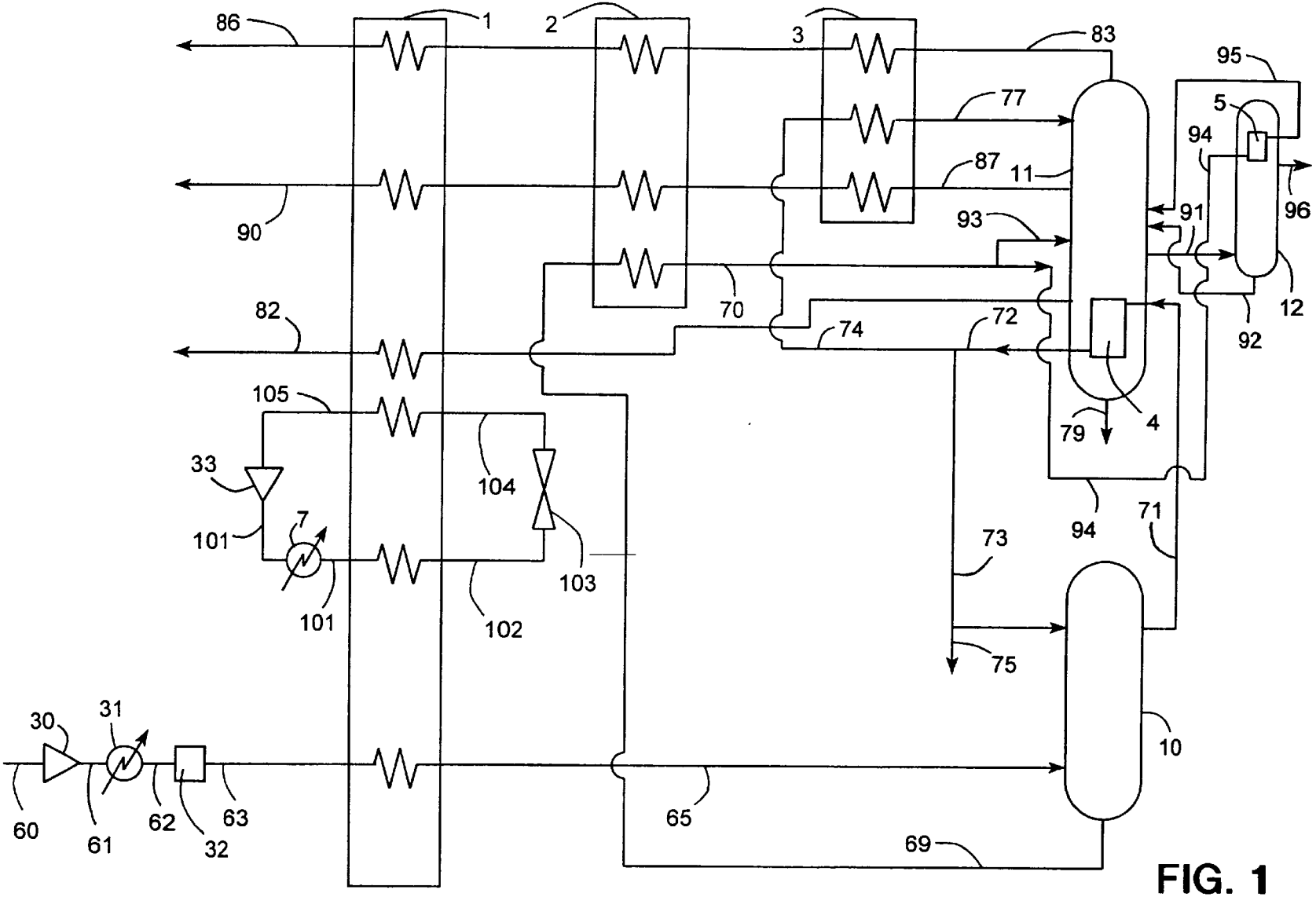
FIG. 1 is a schematic representation of one preferred embodiment of the invention wherein liquid nitrogen and liquid argon are produced in addition to liquid oxygen.

The invention will be described in greater detail with reference to the Drawings. In FIG. 1 there is illustrated a cryogenic air separation plant having three columns, a double column having higher and lower pressure columns, and an argon sidearm column.

Referring now to FIG. 1, feed air 60 is compressed by passage through base load compressor 30 to a pressure generally within the range of from 60 to 200 pounds per square inch absolute (psia). Resulting compressed feed air 61 is cooled of the heat of compression in aftercooler 31 and resulting feed air stream 62 is then cleaned of high boiling impurities such as water vapor, carbon dioxide and hydrocarbons by passage through purifier 32. Purified feed air stream 63 is cooled by passage through main heat exchanger 1 by indirect heat exchange with return streams and by refrigeration generated by the multicomponent refrigerant fluid circuit as will be more fully described below, and then passed as stream 65 into higher pressure column 10 which is operating at a pressure generally within the range of from 60 to 200 psia. Within higher pressure column 10 the feed air is separated by cryogenic rectification into nitrogen-enriched vapor and oxygen-enriched liquid. Nitrogen-enriched vapor is withdrawn from the upper portion of higher pressure column 10 in stream 71 and condensed in main condenser 4 by indirect heat exchange with boiling oxygen-rich liquid which is lower pressure column bottom liquid. Resulting nitrogen-enriched liquid 72 is returned to column 10 as reflux as shown by stream 73. A portion 74 of the nitrogen-enriched liquid 72 is passed from column 10 to subcooler 3 wherein it is subcooled to form subcooled stream 77 which is passed into the upper portion of column 11 as reflux. If desired, a portion 75 of stream 73 may be recovered as product liquid nitrogen. Stream 75 may comprise up to 50 percent of the feed air provided into the system.

Oxygen-enriched liquid is withdrawn from the lower portion of higher pressure column 10 in stream 69 and passed to subcooler 2 wherein it is subcooled. Resulting subcooled oxygen-enriched liquid 70 is then divided into portion 93 and portion 94. Portion 93 is passed into lower pressure column 11 and portion 94 is passed into argon column condenser 5 wherein it is at least partially vaporized. The resulting vapor is withdrawn from condenser 5 in stream 95 and passed into lower pressure column 11. Any remaining oxygen-enriched liquid is withdrawn from condenser 5 and then passed into lower pressure column 11.

Lower pressure column 11 is operating at a pressure less than that of higher pressure column 10 and generally within the range of from 15 to 150 psia. Within lower pressure column 11 the various feeds into that column are separated by cryogenic rectification into nitrogen-rich vapor and oxygen-rich liquid. Nitrogen-rich vapor is withdrawn from the upper portion of column 11 in stream 83, warmed by passage through heat exchangers 3, 2 and 1, and may be recovered as product gaseous nitrogen in stream 86 having a nitrogen concentration of at least 99 mole percent, preferably at least 99.9 mole percent, and most preferably at least 99.999 mole percent. For product purity control purposes a waste stream 87 is withdrawn from column 11 from a level below the withdrawal point of stream 83, warmed by passage through heat exchangers 3, 2 and 1, and removed from the system in stream 90. Oxygen-rich liquid is partially vaporized in the lower portion of column 11 by indirect heat exchange with condensing nitrogen-enriched vapor in main condenser 4 as was previously described to provide vapor upflow for column 11. If desired, a portion of the resulting oxygen-rich vapor may be withdrawn from the lower portion of column 11 in stream 81 having an oxygen concentration generally within the range of from 90 to 99.9 mole percent. Oxygen-rich vapor in stream 81 is warmed by passage through main heat exchanger 1 and recovered as product gaseous oxygen in stream 82. Oxygen-rich liquid is withdrawn from the lower portion of column 11 in stream 79 and recovered as product liquid oxygen. Stream 79 may comprise up to 21 percent of the feed air provided into the system.

Fluid comprising oxygen and argon is passed in stream 91 from lower pressure column 11 into third or argon column 12 wherein it is separated by cryogenic rectification into argon-richer fluid and oxygen-richer fluid. Oxygen-richer fluid is passed from the lower portion of column 12 in stream 92 into lower pressure column 11. Argon-richer fluid is passed from the upper portion of column 12 as vapor into argon column condenser 5 wherein it is condensed by indirect heat exchange with the aforesaid subcooled oxygen-enriched liquid. Resulting argon-richer liquid is withdrawn from condenser 5. At least a portion of the argon-richer liquid is passed into argon column 12 as reflux and, if desired, another portion is recovered as product liquid argon as shown by stream 96. Stream 96 may comprise up to 0.93 percent of the feed air provided into the system.

There will now be described in greater detail the operation of the multicomponent refrigerant fluid circuit which serves to generate preferably all the refrigeration passed into the cryogenic rectification plant thereby eliminating the need for any turboexpansion of a process stream to produce refrigeration for the separation, thus decoupling the generation of refrigeration for the cryogenic air separation process from the flow of process streams, such as feed air, associated with the cryogenic air separation process.

The following description illustrates the multicomponent refrigerant fluid system for providing refrigeration throughout the primary heat exchanger 1. Multicomponent refrigerant fluid in stream 105 is compressed by passage through recycle compressor 33 to a pressure generally within the range of from 45 to 800 psia to produce compressed refrigerant fluid 106. The compressed refrigerant fluid is cooled of the heat of compression by passage through aftercooler 34 and may be partially condensed. The resulting multicomponent refrigerant fluid in stream 101 is then passed through heat exchanger 1 wherein it is further cooled and generally is at least partially condensed and may be completely condensed. The resulting cooled, compressed multicomponent refrigerant fluid 102 is then expanded or throttled through valve 103. The throttling preferably partially vaporizes the multicomponent refrigerant fluid, cooling the fluid and generating refrigeration. For some limited circumstances, dependent on heat exchanger conditions, the compressed fluid 102 may be subcooled liquid prior to expansion and may remain as liquid upon initial expansion. Subsequently, upon warming in the heat exchanger, the fluid will have two phases. The pressure expansion of the fluid through a valve would provide refrigeration by the Joule-Thomson effect, i.e. lowering of the fluid temperature due to pressure expansion at constant enthalpy. However, under some circumstances, the fluid expansion could occur by utilizing a two-phase or liquid expansion turbine, so that the fluid temperature would be lowered due to work expansion.

Refrigeration bearing multicomponent two phase refrigerant fluid stream 104 is then passed through heat exchanger 1 wherein it is warmed and completely vaporized thus serving by indirect heat exchange to cool stream 101 and also to transfer refrigeration into the process streams within the heat exchanger, including feed air stream 63, thus passing refrigeration generated by the multicomponent refrigerant fluid refrigeration circuit into the cryogenic rectification plant to sustain the cryogenic air separation process. The resulting warmed multicomponent refrigerant fluid in vapor stream 105 is then recycled to compressor 33 and the refrigeration cycle starts anew. In the multicomponent refrigerant fluid refrigeration cycle while the high pressure mixture is condensing, the low pressure mixture is boiling against it, i.e. the heat of condensation boils the low-pressure liquid. At each temperature level, the net difference between the vaporization and the condensation provides the refrigeration. For a given refrigerant component combination, mixture composition, flowrate and pressure levels determine the available refrigeration at each temperature level.

The multicomponent refrigerant fluid contains two or more components in order to provide the required refrigeration at each temperature. The choice of refrigerant components will depend on the refrigeration load versus temperature for the specific process. Suitable components will be chosen depending upon their normal boiling points, latent heat, and flammability, toxicity, and ozone-depletion potential.

Figure 2:
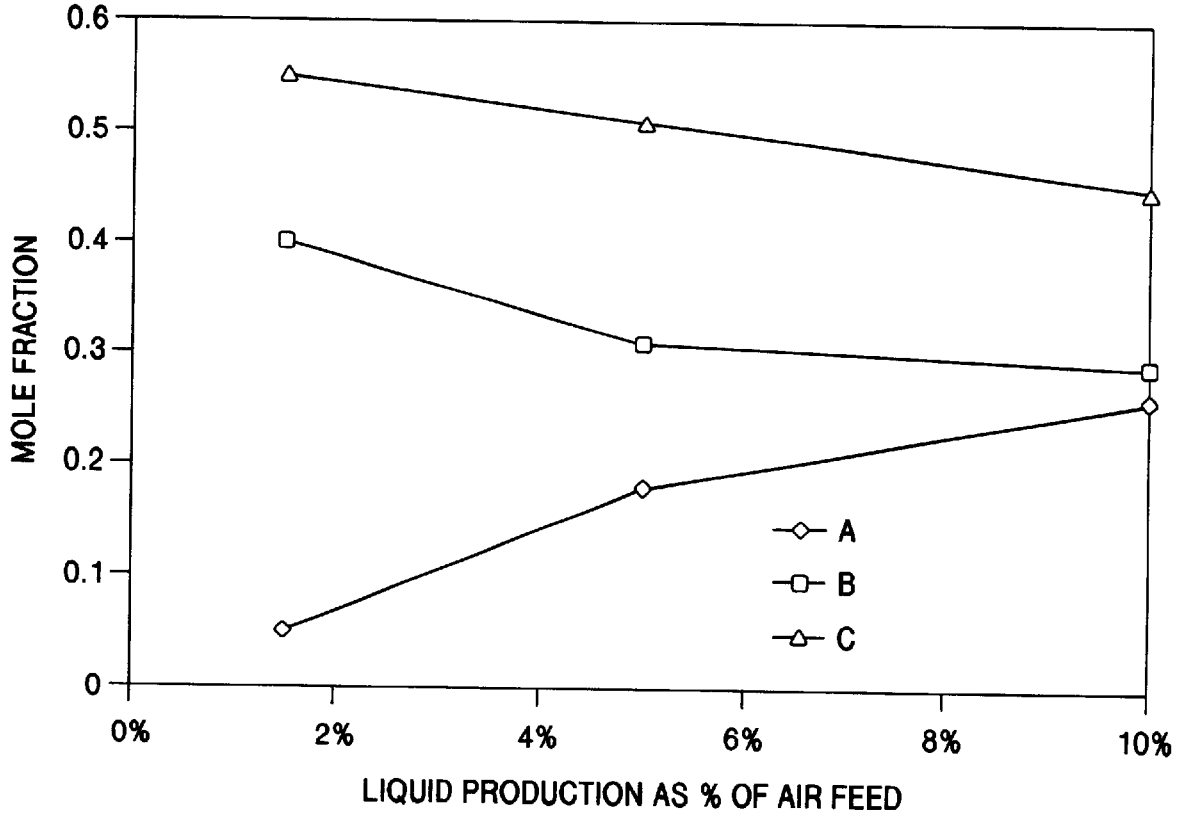
FIG. 2 is a graphical representation showing a preferred change in the composition of the multicomponent refrigerant mixture as the production of liquid as a percentage of the feed air changes.

FIG. 2 illustrates one preferred system for changing the composition of the multicomponent refrigerant fluid among low boiling component(s), as shown by curve A, medium boiling component(s), as shown by curve B, and high boiling component(s), as shown by curve C, as the total liquid production, i.e. the sum total of liquid oxygen, liquid nitrogen, and liquid argon produced and recovered using the system, changes. As can be seen from FIG. 2, when the total liquid production is about 5 percent of the feed air, the mole fraction of low boiling component(s) in the multicomponent refrigerant fluid is less than 0.2, the mole fraction of medium boiling component(s) exceeds 0.3, and the mole fraction of high boiling component(s) exceeds 0.5. When the total liquid production is 10 percent or more of the feed air, the mole fraction of low boiling component(s) in the multicomponent refrigerant fluid exceeds 0.2, the mole fraction of medium boiling component(s) is less than 0.3, and the mole fraction of the high boiling component(s) is less than 0.5.

One preferable embodiment of the multicomponent refrigerant fluid useful in the practice of this invention comprises at least two components from the group consisting of fluorocarbons, hydrofluorocarbons and fluoroethers.

Another preferable embodiment of the multicomponent refrigerant fluid useful in the practice of this invention comprises at least one component from the group consisting of fluorocarbons, hydrofluorocarbons and fluoroethers, and at least one atmospheric gas.

Another preferable embodiment of the multicomponent refrigerant fluid useful in the practice of this invention comprises at least two components from the group consisting of fluorocarbons, hydrofluorocarbons and fluoroethers, and at least two atmospheric gases.

Another preferable embodiment of the multicomponent refrigerant fluid useful in the practice of this invention comprises at least one fluoroether and at least one component from the group consisting of fluorocarbons, hydrofluorocarbons, fluoroethers and atmospheric gases.

In one preferred embodiment the multicomponent refrigerant fluid consists solely of fluorocarbons. In another preferred embodiment the multicomponent refrigerant fluid consists solely of fluorocarbons and hydrofluorocarbons. In another preferred embodiment the multicomponent refrigerant fluid consists solely of fluorocarbons and atmospheric gases. In another preferred embodiment the multicomponent refrigerant fluid consists solely of fluorocarbons, hydrofluorocarbons and fluoroethers. In another preferred embodiment the multicomponent refrigerant fluid consists solely of fluorocarbons, fluoroethers and atmospheric gases.

The multicomponent refrigerant fluid useful in the practice of this invention may contain other components such as hydrochlorofluorocarbons and/or hydrocarbons. Preferably, the multicomponent refrigerant fluid contains no hydrochlorofluorocarbons. In another preferred embodiment of the invention the multicomponent refrigerant fluid contains no hydrocarbons. Most preferably the multicomponent refrigerant fluid contains neither hydrochlorofluorocarbons nor hydrocarbons. Most preferably the multicomponent refrigerant fluid is non-toxic, non-flammable and non-ozone-depleting and most preferably every component of the multicomponent refrigerant fluid is either a fluorocarbon, hydrofluorocarbon, fluoroether or atmospheric gas.

One preferred example of the multicomponent refrigerant fluid useful in the practice of this invention comprises 18 mole percent Ar, 31 mole percent $CF_4$, 35 mole percent $C_2HF_5$ and 16 mole percent $CHCl_2F_3$.

The invention is particularly advantageous for use in efficiently reaching cryogenic temperatures from ambient temperatures. Tables 1–9 list preferred examples of multicomponent refrigerant fluid mixtures useful in the practice of this invention. The concentration ranges given in the Tables are in mole percent.

TABLE 1

| COMPONENT | CONCENTRATION RANGE |
|---|---|
| $C_5F_{12}$ | 5–25 |
| $C_4F_{10}$ | 0–15 |
| $C_3F_8$ | 10–40 |
| $C_2F_6$ | 0–30 |
| $CF_4$ | 10–50 |
| Ar | 5–40 |
| $N_2$ | 0–30 |

TABLE 2

| COMPONENT | CONCENTRATION RANGE |
|---|---|
| $C_3H_3F_5$ | 5–25 |
| $C_4F_{10}$ | 0–15 |
| $C_3F_8$ | 10–40 |
| $CHF_3$ | 0–30 |
| $CF_4$ | 10–50 |
| Ar | 5–40 |
| $N_2$ | 0–80 |

TABLE 3

| COMPONENT | CONCENTRATION RANGE |
|---|---|
| $C_4H_4F_6$ | 5–25 |
| $C_3H_2F_6$ | 0–15 |
| $C_2H_2F_4$ | 0–20 |
| $C_2HF_5$ | 5–20 |
| $C_2F_6$ | 0–30 |
| $CF_4$ | 10–50 |
| Ar | 5–40 |
| $N_2$ | 0–80 |

TABLE 4

| COMPONENT | CONCENTRATION RANGE |
|---|---|
| $C_3F_7$—O—$CH_3$ | 5–25 |
| $C_4H_{10}$ | 0–15 |
| $CF_3$—O—$C_2F_3$ | 10–40 |
| $C_2F_6$ | 0–30 |
| $CF_4$ | 10–50 |
| Ar | 5–40 |
| $N_2$ | 0–80 |

TABLE 5

| COMPONENT | CONCENTRATION RANGE |
|---|---|
| $C_3H_3F_5$ | 5–25 |
| $C_3H_2F_6$ | 0–15 |
| $CF_3$—O—$C_2F_3$ | 10–40 |
| $CHF_3$ | 0–30 |
| $CF_4$ | 0–25 |
| Ar | 5–40 |
| $N_2$ | 0–80 |

TABLE 6

| COMPONENT | CONCENTRATION RANGE |
|---|---|
| $C_3HCl_2F_5$ | 5–25 |
| $C_2HClF_4$ | 0–15 |
| $C_2HF_5$ | 10–40 |
| $CHF_3$ | 0–30 |
| $CF_4$ | 0–25 |
| Ar | 5–40 |
| $N_2$ | 0–80 |

TABLE 7

| COMPONENT | CONCENTRATION RANGE |
|---|---|
| $C_2HCl_2F_3$ | 5–25 |
| $C_2HClF_4$ | 0–15 |
| $CF_3$—O—$C_2F_3$ | 10–40 |
| $CHF_3$ | 0–30 |
| $CF_4$ | 0–25 |
| Ar | 5–40 |
| $N_2$ | 0–80 |

TABLE 8

| COMPONENT | CONCENTRATION RANGE |
|---|---|
| $C_2HCl_2F_3$ | 5–25 |
| $C_2HClF_4$ | 0–15 |
| $C_2H_2F_4$ | 0–15 |
| $C_2HF_5$ | 10–40 |
| $CHF_3$ | 0–30 |
| $CF_4$ | 0–25 |
| Ar | 5–40 |
| $N_2$ | 0–80 |

TABLE 9

| COMPONENT | CONCENTRATION RANGE |
|---|---|
| $C_2HCl_2F_3$ | 5–25 |
| $C_2HClF_4$ | 0–15 |
| $C_2H_2F_4$ | 5–15 |
| $C_2HF_5$ | 5–40 |
| $CHF_3$ | 0–30 |
| $CF_4$ | 0–25 |
| Ar | 5–40 |
| $N_2$ | 0–80 |

In a preferred embodiment of the invention each of the two or more components of the refrigerant mixture has a normal boiling point which differs by at least 5 degrees Kelvin, more preferably by at least 10 degrees Kelvin, and most preferably by at least 20 degrees Kelvin, from the normal boiling point of every other component in the refrigerant mixture. This enhances the effectiveness of providing refrigeration over a wide temperature range which encompasses cryogenic temperatures. In a particularly preferred embodiment of the invention, the normal boiling point of the highest boiling component of the multicomponent refrigerant fluid is at least 50° K, preferably at least 100° K, most preferably at least 200° K, greater than the normal boiling point of the lowest boiling component of the multicomponent refrigerant fluid.

The components and their concentrations which make up the multicomponent refrigerant fluids useful in the practice of this invention preferably are such as to form a variable load multicomponent refrigerant fluid and preferably maintain such a variable load characteristic throughout the whole temperature range of the method of the invention. This markedly enhances the efficiency with which the refrigeration can be generated and utilized over such a wide temperature range. The defined preferred group of components has an added benefit in that they can be used to form fluid mixtures which are non-toxic, non-flammable and low or non-ozone-depleting. This provides additional advantages over conventional refrigerants which typically are toxic, flammable and/or ozone-depleting.

One preferred variable load multicomponent refrigerant fluid useful in the practice of this invention which is non-toxic, non-flammable and non-ozone-depleting comprises two or more components from the group consisting of $C_5F_{12}$, $CHF_2$—O—$C_2HF_4$, $C_4HF_9$, $C_3H_3F_5$, $C_2F_5$—O—$CH_2F$, $C_3H_2F_6$, $CHF_2$—O—$CHF_2$, $C_4F_{10}$, $CF_3$—O—$C_2H_2F_3$, $C_3HF_7$, $CH_2F$—O—$CF_3$, $C_2H_2F_4$, $CHF_2$—O—$CF_3$, $C_3F_8$, $C_2HF_5$, $CF_3$—O—$CF_3$, $C_2F_6$, $CHF_3$, $CF_4$, $CF_4F_9$—O—$CH_3$, $C_6F_{14}$, $C_5HF_{11}$, $C_5H_2F_{10}$, $C_3F_7$—O—$CH_3$, $C_4H_4F_6$, $C_2F_5$—O—$CH_3$, $CO_2$, $O_2$, Ar, $N_2$, Ne and He.

Although the invention has been described in detail with reference to certain preferred embodiments, those skilled in the art will recognize that there are other embodiments of the invention within the spirit and the scope of the claims. For example, more than one multicomponent refrigerant fluid refrigeration circuit may be used to generate the refrigeration for the system, with each individual multicomponent refrigerant fluid circuit employing a different multicomponent refrigerant fluid, i.e. having one or more different components and/or concentrations.

In another embodiment the multicomponent refrigerant fluid refrigeration circuit in the practice of this invention may employ internal recycle wherein the compression is followed by at least one step of partial condensation at an intermediate temperature, followed by separation, throttling and recycle of the condensate, with the returning vapor portion, after evaporation to the suction of the compressor. Removal or recycle of the high boiling point component(s) provides higher thermodynamic efficiencies and eliminates the possibility of freeze up at the lower temperatures.

What is claimed is:

1. A process for the production of liquid oxygen by the cryogenic rectification of feed air comprising:

(A) compressing a multicomponent refrigerant fluid, cooling the compressed multicomponent refrigerant fluid, expanding the cooled, compressed multicomponent refrigerant fluid, and warming the expanded multicomponent refrigerant fluid by indirect heat exchange with said cooling compressed multicomponent refrigerant fluid and also with feed air to produce cooled feed air;

(B) passing the cooled feed air into a higher pressure cryogenic rectification column and separating the feed air by cryogenic rectification within the higher pressure cryogenic rectification column into nitrogen-enriched fluid and oxygen-enriched fluid;

(C) passing nitrogen-enriched fluid and oxygen-enriched fluid into a lower pressure cryogenic rectification column, and separating the fluids passed into the lower pressure column by cryogenic rectification to produce nitrogen-rich fluid and oxygen-rich fluid; and (D) withdrawing oxygen-rich fluid from the lower portion of the lower pressure column liquid and recovering the withdrawn oxygen-rich fluid as product liquid oxygen.

2. The process of claim 1 further comprising recovering a portion of the nitrogen-enriched fluid as product liquid nitrogen.

3. The process of claim 1 further comprising passing a stream comprising oxygen and argon from the lower pressure column into a third column, producing argon-richer fluid by cryogenic rectification within the third column, and recovering argon-richer fluid from the third column as product liquid argon.

4. The process of claim 1 wherein the multicomponent refrigerant fluid comprises at least one low boiling component, at least one medium boiling component, and at least one high boiling component, and wherein the mole fraction of the low boiling component(s) is less than 0.2, the mole fraction of the medium boiling component(s) exceeds 0.3, and the mole fraction of the high boiling component(s) exceeds 0.5.

5. The process of claim 1 wherein the multicomponent refrigerant fluid comprises at least one low boiling component, at least one medium boiling component and at least one high boiling component, and wherein the mole fraction of the low boiling component(s) exceeds 0.2, the mole fraction of the medium boiling component(s) is less than 0.3, and the mole fraction of the high boiling component(s) is less than 0.5.

6. The process of claim 1 wherein the expansion of the cooled, compressed multicomponent refrigerant fluid produces a two-phase multicomponent refrigerant fluid.

7. The process of claim 1 wherein the multicomponent refrigerant fluid comprises at least two components from the group consisting of fluorocarbons, hydrofluorocarbons and fluoroethers.

8. The process of claim 1 wherein the multicomponent refrigerant fluid comprises at least one component from the group consisting of fluorocarbons, hydrofluorocarbons and fluoroethers and at least one atmospheric gas.

9. The process of claim 1 wherein the multicomponent refrigerant fluid comprises at least two components from the group consisting of fluorocarbons, hydrofluorocarbons and fluoroethers and at least two atmospheric gases.

10. The process of claim 1 wherein the multicomponent refrigerant fluid comprises at least one component from the group consisting of fluorocarbons, hydrofluorocarbons, hydrochlorofluorocarbons and fluoroethers, and at least one atmospheric gas.

* * * * *